United States Patent [19]

Walsh et al.

[11] 4,014,648

[45] Mar. 29, 1977

[54] IN-LINE FLOCK CUTTING PROCESS

[75] Inventors: David I. Walsh, Barrington, R.I.; James P. Casey, Seekonk, Mass.; George E. Corneau, Central Falls, R.I.; William F. Laird, Kingston, Canada

[73] Assignee: Microfibres, Inc., Pawtucket, R.I.

[22] Filed: Nov. 8, 1974

[21] Appl. No.: 522,044

[52] U.S. Cl. ..... 8/138; 8/115.6; 8/137.5; 19/.32; 19/.46; 19/.56; 19/.58; 19/.6; 28/76 R; 83/913; 427/26; 427/32

[51] Int. Cl.[2] ..... D06B 15/00; D06L 1/22; D06M 9/00

[58] Field of Search ..... 8/137.5, 138; 28/76 R; 83/913; 427/25, 206, 26, 32; 19/.32, .46, .56, .58, .6

[56] References Cited

UNITED STATES PATENTS

| | | | |
|---|---|---|---|
| 2,908,944 | 10/1959 | Benninga et al. | 19/.46 |
| 3,498,816 | 3/1970 | Finch et al. | 427/26 |
| 3,791,788 | 2/1974 | Taylor | 8/137.5 |
| 3,798,048 | 3/1974 | Brody et al. | 427/25 |

FOREIGN PATENTS OR APPLICATIONS

| | | | |
|---|---|---|---|
| 1,008,637 | 11/1965 | United Kingdom | 8/138 |
| 1,008,638 | 11/1965 | United Kingdom | 8/138 |

OTHER PUBLICATIONS

Crawford, *Industrial Finishing*, for July, 1934, pp. 28 and 30.

*Primary Examiner*—Allan Lieberman

[57] ABSTRACT

A continuous in-line flock cutting process is disclosed, for making flock from tow which contains a lubricant which is detrimental to the flock and must be removed.

The tow is continuously fed, heat treated and immersed in an aqueous scouring liquid, and is continuously wet-processed. The excess scouring liquid is squeezed out, the tow is rinsed with water, rinse water is squeezed out, and a finish is applied to the tow and partially squeezed out in an in-line continuous process to remove a portion of the applied finish. Thus processed, the still-wet tow is continuously cut into wet flock, the wet flock is then dried and beaten to open up and separate the individual flock particles, and screened.

8 Claims, 2 Drawing Figures

IN-LINE FLOCK CUTTING PROCESS

BRIEF DESCRIPTION OF THE INVENTION

This invention relates to a novel in-line process for making a highly improved flock product from tow, and relates more particularly to a wet continuous two-processing operation wherein the filaments are scoured, rinsed and finished while they are still in the form of a tow, and wherein the processed two is continuously cut, in the wet stage, into flock and dried to a controlled moisture content.

In connection with this invention the word "tow" is intended to be interpreted broadly, including conventional continuous filament tow, discontinuous filamentary materials including garnetted waste, cotton yarn, sliver and various other aggregations or bundles of filamentary material. Tow sometimes includes some crimped filaments and surface lubricant which are detrimental to the desired flock product, in that the crimps interfere with the desired straightness of the flock particles, and the lubricant interferes with the flow and electrostatic handling properties of the flock during the electrostatic flocking process.

DISCUSSION OF THE PRIOR ART

Heretofore, it has been conventional to cut the tow initially, regardless of the presence of crimps and of lubricant or other finishing materials (often referred to as "spin finish"), and then to scour, rinse and dye the cut flock, centrifuge the flock, tank treat the flock for removal of spin finish or other lubricants, centrifuge the flock again, tank finish the centrifuged flock for the application of a finish solution which improves the handling properties of the flock during the electrostatic flocking process, centrifuge the flock still again, and then dry the flock, screen it in-line and bag it. Such a process is unduly time-consuming and expensive, particularly in its requirement for at least three separate and distinct, highly costly centrifuging processes.

It has also been known to conduct the tow through a dye bath, and then to scour and rinse the tow continuously, followed by drying the tow, and then to apply a tank finish to the tow, followed by still another drying operation, which is then followed by cutting. Again, such a process is unduly laborious, time-consuming and expensive, particularly in view of the fact that it requires at least two separate and distinct drying processes, which are extremely costly and require a substantial use of drying heat and fuel.

Other prior art processes for the production of flock are known, but all of these have substantial drawbacks of the type referred to above.

OBJECTS OF THE INVENTION

It is accordingly an object of this invention to provide a new, continuous in-line process for the production of high quality flock from tow which is composed of a multiplicity of crimped or non-crimped filaments, to which a normal "spin finish" or lubricant has been applied, all in a continuous manner and with extreme reliability and economy.

Other objects and advantages of this invention will further become apparent hereinafter and in the drawings.

DRAWINGS

The drawing is a flow diagram showing a process for producing flock from tow in accordance with one embodiment of this invention. FIG. 1*a* and FIG. 1*b* are presented on separate sheets for ease of illustration, but as will be apparent hereinafter, the tow proceeding from the right hand end of FIG. 1*a* travels to the left hand end of FIG. 1*b*, without interruption.

DETAILED DESCRIPTION OF THE INVENTION

Figure 1A:
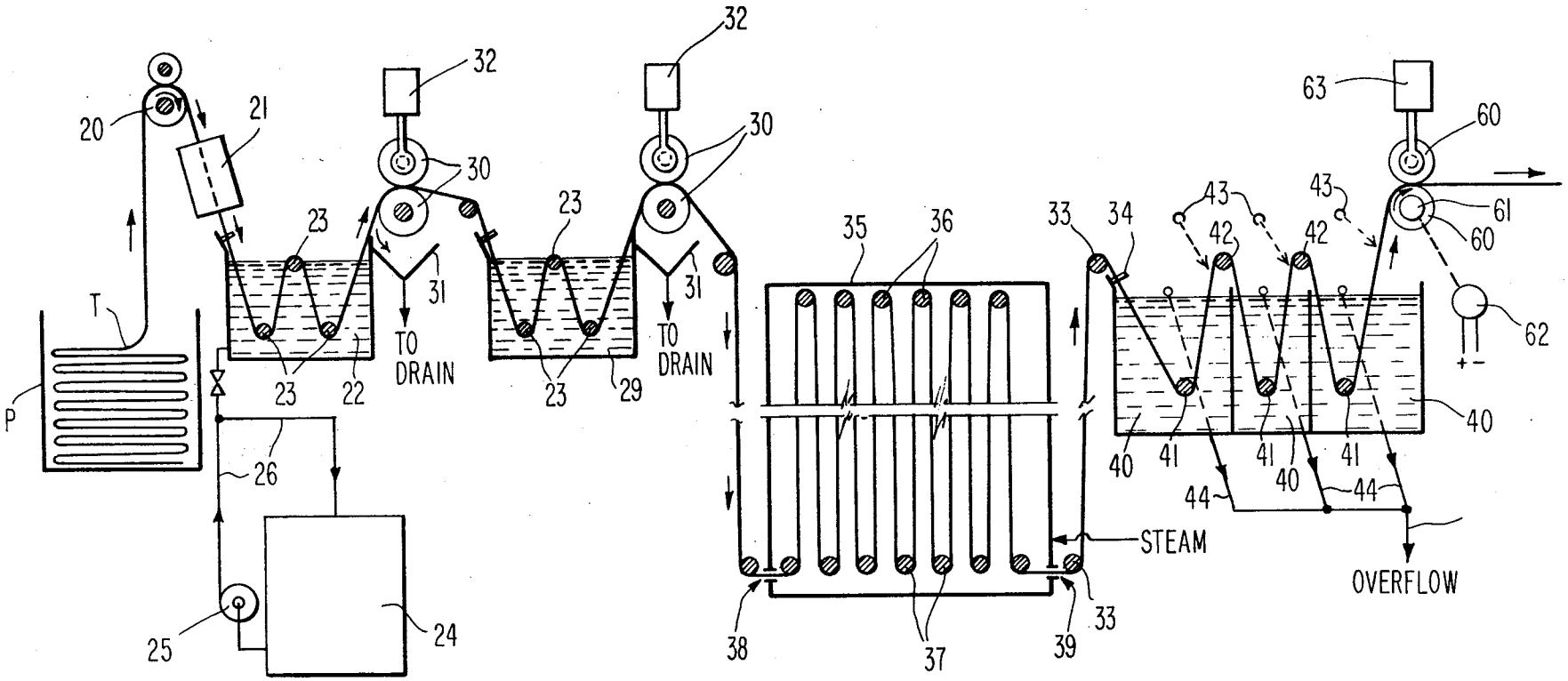

It has been discovered that a highly excellent flock product can be prepared continuously and economically by continuously feeding the tow as a running tow, optionally heat treating the running tow while maintaining the tow under tension, continuously scouring the tow by contacting it with a liquid scouring agent for removal of the lubricant from the tow, squeezing excess scouring liquid from the tow, rinsing the tow with water, applying a predetermined pressure to squeeze excess rinse water from the rinsed tow, applying a liquid finish to the tow, applying another predetermined pressure to the tow to remove a portion only of the applied finish, and then continuously cutting the resulting tow into flock, followed by drying the flock and beating the dried flock to open up and to separate individual flock particles. As a further step in accordance with this process, it is highly desirable to screen the flock, to remove and re-cut excessively long flock particles, particularly when precision cutting is used.

It will be observed accordingly that the tow is continuously processed in the wet stage, beginning with a stage at which the tow may contain a spin finish or lubricant, completely through the scouring, rinsing and finishing stages, and that the tow is continuously cut into flock while it is still wet. Further, according to this process, the wet flock is dried as flock, whereupon it is subjected to beating in order to separate the flock particles, to open up the flock and to deliver the flock for final processing.

It has been discovered that it is critical to control the moisture regain value of the flock, both after the drying step and after the subsequent beating step. Critical moisture regain values are, of course, different with respect to the different materials of which the flock is composed, such as rayon, nylon, polyester and acrylic fibers.

It has also been discovered that it is important, after the drying step has been completed, to carry out the beating or "opening-up" step with respect to the flock with the admission of outside air, and to divert the hot moist air from the dryer so that it flows to a point that is remote from the heating step, and to limit the temperature of the air that is admitted to the beating step to a temperature below about 100° F.

Although the following description relates to certain preferred forms of the invention as illustrated in the drawing, and while specific terms will be used for the sake of convenience and clarity in describing the embodiments of the invention selected for illustration in the drawing, it will be appreciated that such specific terms are not intended to limit the scope of the invention, which is defined in the appended claims.

Figure 1B:
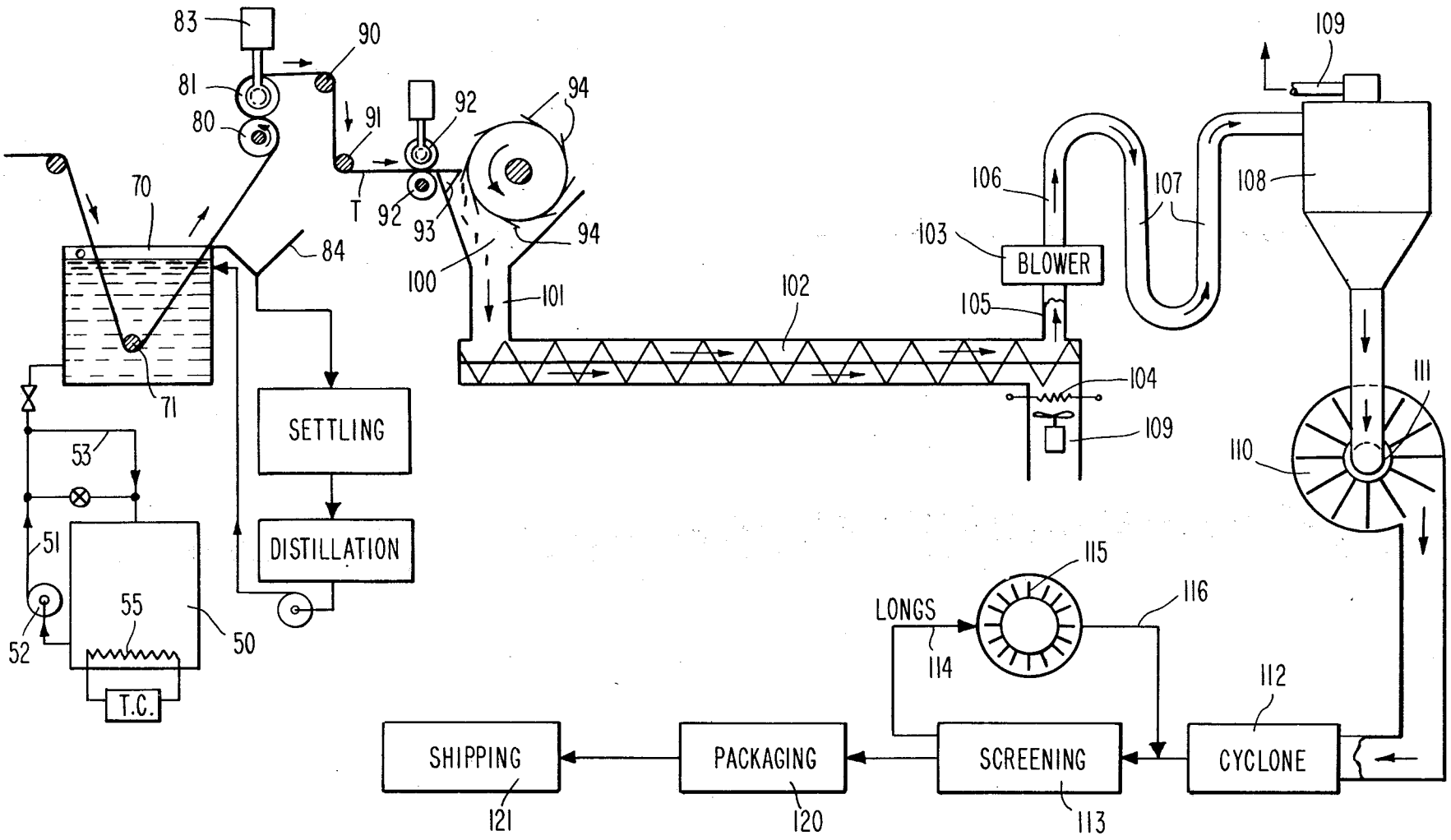

Turning now to the drawing, and particularly FIG. 1*a* the tow T is shown in a package P, which is a typical package in which tow may be shipped from one place to another, with the tow usually flaked or snaked down in a serpentine manner within the package P. Of course, the tow may be supplied continuously from a tow manufacturing process, or may be provided in any manner other than the specific manner shown in FIG. 1, utilizing a package P.

In any event, the tow T is continuously conducted upwardly over a roller 20, and then optionally passes through an infrared heater 21 while maintained under tension. Obviously, other forms of heaters may be substituted for the infrared heater 21. Polymers such as polyesters are heat-set in a straight condition by the action of the infrared heater 21. This is highly effective and advantageous in accordance with this invention, because it is highly desirable to produce a precision cut flock wherein each one of the flock particles is heat-set and is substantially perfectly straight, and will stand up in a vertical manner from the base fabric to which it is applied in a conventional electrostatic flocking process. Some tows have been crimped, and it is not desirable to heat-set the crimp, and for such tows the heater 21 is not used. Those tows that are heated by heater 21 are then cooled in air.

The number 22 designates a pad box, often used as a scour tank or as a bleach or dyestuff applicator. It has a plurality of rolls 23, 23, 23 over which the tow is continuously conducted while under tension, and containing a scouring, bleaching or dyeing emulsion or solution, whereby the tow is immersed in and removed from, and then immersed again in the solution. When the solution is a scour solution, it may be composed of an alkali and a non-ionic detergent, for example, and serves the purpose of removing the producer's finish which is usually a lubricant or a so-called "spin finish" which is considered by the producer to be necessary to produce and to handle tow. It is considered quite necessary to substantially completely remove the producer's finish in order to produce high grade flock. The specific nature of the scouring chemicals is, of course, important, and chemical balance is quite critical particularly in view of the fact that the finish that is applied to the tow, though a water solution finish, is composed of a variety of complex chemical additives which are subject to serious degradation if balance is allowed to change excessively.

The chemicals used in the scour solution, in accordance with this invention, are continuously circulated between a master tank and the scour solution tank 22. The use of a recirculating system keeps the scour solution flowing to the point of scour application. This is highly important. Referring to FIG. 1, accordingly, the master tank 24 is provided for containing the scour solution, which is pumped by pump 25 to the scour application tank 22, and is returned through line 26 to the master tank 24, in order to provide a continuous circulating and recirculating system for the scour solution.

The number 30 designates a pair of squeeze rolls for the scour solution, operating above a baffle 31 in such a manner as to collect the excess scour solution, which is passed off to the drain as indicated by the arrow in the drawings. The upper squeeze roll 30 is controlled by a pneumatic cylinder 32, which applies a controlled downward pressure against the lower roll 30, providing a predetermined nip roll pressure for the squeeze rolls which is a highly important and advantageous feature of this invention, as will further be explained in detail hereinafter.

Immediately following the tank or pad box 22 is another tank or pad box 29, which may desirably have a construction which is the same as the tank 22, including parts which are similarly numbered, including the immersion and guide rolls 23, the squeeze rolls 30, the pneumatic cylinder 32 and the baffle 31 leading to the drain. It will be understood that, in some cases both boxes 22 and 29 are used in series with each other and that in other cases the use of one or the other of these boxes may be by-passed.

For example, in the processing of rayon, it is possible for the dye and the scour solution to be present in the same bath, in which case they may both be placed conveniently in the bath contained in pad box 22, and the product emerging from between the squeeze rolls 30, 30 can be directed to bypass the box 29. On the other hand, with some types of rayon and with some desired types of rayon products, it is considered necessary to bleach the rayon, in which case the box 22 may desirably be used as a scour box and the box 29 used as a bleach box. It will be apparent that various other combinations are avaiable, utilizing the pad boxes 22 and 29, in the processing of rayon.

In the processing of polymeric materials such as nylon, polyester and acrylics, it is usually quite difficult to process these materials with a scour solution and a dye solution in the same bath. Accordingly, the pad box 22 usually contains a scour solution and the pad box 29 usually contains a dyestuff solution which is to be padded on to the tow. Accordingly, in processing these polymeric materials, it is not usual to by-pass the pad box 29.

If desired, the pad box may be provided with a recirculation system like the members 24, 25, and 26.

Upon emerging from the pad-box 29, or directly from the tank 22, the tow passes to and through a bleach box or ager 35. If dye has been padded on to the tow, this tank 35 serves as an ager or dye developer. If bleach has been padded on to the tow, the box 35 serves as a bleach box. Similarly, since heat and steam are present in the box 35, crimp can be pulled out by the simultaneous application of steam heat plus tension.

As shown in the drawings, the box 35 is much higher than it is long, it has a plurality of upper guide rolls 36 and lower guide rolls 37 over and under which the tow repeatedly passes for exposure to steam.

The upper guide rolls 36 are preferably driven in a manner to provide tension control for the tow as it passes in serpentine fashion through the dye tank 29 and bleach box 35. The bleach box 35 has an entrance slot 38 and an exit slot 39 for the tow.

Thus, when rayon tow is being processed, the infrared heater 21 is not used, but the pad box 29 (for application of bleach) and steam box 35 are used. When the tow is nylon, polyester or acrylic, the infrared heater 21 may be used, the box 22 is scour box and the box 29 used as a dye applicator. Alternatively, the box 29 may be used to pad on a scouring liquid, either with or without the use of scour tank 22.

After leaving the bleach tank 35, the tow passes under tension over idler rolls 33, 33 and then downwardly between a plurality of tow guide or separator pins 34, which spread out and uniformly distribute the band of tow as it passes into the rinse tank 40. The rinse tank 40 has a plurality of submerged rolls 41, 41, 41 and a pair of upper rolls 42, 42, whereby the tow is successively immersed, removed, immersed, removed, immersed and then removed again from the solution contained in the rinse tank. Spray pipes 43 for mixed steam and water are provided above the tensioned tow as it emerges from the rinse tank and just before it passes over each upper roll 42, thus applying a rinse solution, or a hot water rinse, to the tow. Rinse tank 40 overflows through the lines 44, as shown.

The number 60 designates a pair of high pressure nip rolls, just downstream of the rinse tank, the speed of which is controlled by a variable speed drive motor 61 having a speed adjusting control of a conventional type, bearing the number 62. In this manner the speed of the drive for the entire tow line may be rigidly controlled, and it is accordingly quite simple to provide a highly accurate and controllable degree of tension upon the tow during the various process stages according to this invention.

The number 63 designates a pneumatic cylinder applicable upon the upper and lower rolls 60, 60, which is adjustable in the usual manner to provide an adjustable high pressure between the rolls 60, 60. This is an important and advantageous feature of this invention, as will further become apparent hereinafter. A typical value for pressure to be applied between the rolls 60, 60, is about 60 – 120 pounds per square inch, for example.

The number 70 (FIG. 1*b*) designates a finish tank, containing a finish solution which is specifically adapted to provide a finish for the tow which will improve the handling qualities of the flock, once it has been cut, in the electrostatic flocking chamber in which it is intended to be used. The finish tank 70 has an immersion roll 71 under which the tensioned tow is passed, for the application of a finish solution to the tow.

It will be observed that the tank 70 is heated, and is provided with a recirculating pipe 51, pump 52 and return pipe 53 for continuously recirculating and returning the finish solution to and from the master tank.

Upon emerging from the finish tank 70, the tow passes through the nip between rolls 80 and 81. Roll 81 is actuated by a pneumatic cylinder 83, the pressure of which is controllable in a manner well known in the art. In this manner, the rolls 80 and 81 are maintained under a pressure which may be controlled at will. As the tow passes through the nip between the rolls 80 and 81, a portion of the finish solution is drained back downwardly and caught in a pan 84, from which it is conducted to a settling tank and a distillation apparatus, recovering water and finish chemicals, which are pumped back to tank 70.

After passing through the nip 80, 81, the tow passes over an idler roll 90 and under another idler roll 91 and advances to the cutter advancing rolls 92, 92 which are the feed rolls for the flock cutter itself.

The cutter includes a usual cutter bed knife 93, and a plurality of rotating cutter blades 94, driven in rotation in the usual manner by a motor (not shown), and at a controllable speed in order to provide a precision cut for the flock that is advanced in a precision manner between the cutter advancing rolls 92, 92. Other forms of precision cutters may be used, including cutters as disclosed in the co-pending application Ser. No. 413,902, filed Nov. 8, 1973, assigned to the assignee hereof, now U.S. Pat. No. 3,861,257.

The number 100 designates a hopper arranged to collect the cut flock continuously, whereupon the flock falls through the duct 101 to a horizontal screw conveyor 102 which conveys the flock along toward a blower 103. The number 104 designates a heater for the introduction of hot air into the duct 105 leading to the blower 103, whereupon the hot air mixes intimately with the wet, cut flock, drying it in the passage 105 and in the further passage 106, and in the serpentine passage 107. The dried flock is collected in a cyclone 108 of the usual type, and the dried flock is introduced into a beater 110, containing a multiplicity of beater arms which beat the flock and open up the individual flock particles, separating them and making a uniform flock. It will be observed that the air from the dryer 104 passes off at the upper part of the cyclone, through the outlet 109, and is not conducted along with the flock into the heater 110, which has a separate opening 111 for the admission of air at room temperature or thereabouts, which is admixed with the flock in the heating operation as it is conducted by the beater 110.

Upon emerging from the beater 110, the flock is passed again to a cyclone 112 and delivered to a screening operation 113. The long fibers which are not accepted by the screen are conducted through a conduit 114 to a random length cutter 115, and the product of the random cutter 115 is conducted through a conduit 116 back to the mainstream, just upstream of the screening process 113.

Upon emerging from the screening process, the flock is then packaged in the usual manner at the packaging station 120, and is moved on to the shipping station 121 or handled in any other desired manner, as finished, commercially highly acceptable flock.

It is important to observe that the process in accordance with this invention practices the step of scouring in-line, which is a highly advantageous feature of this invention. Heretofore, it has been considered desirable or necessary to scour, rinse and dry as a tow, then to apply finish as a tow and to dry the tow again. After this, it was considered neccessary to package the tow and deliver the tow package to the cutter, which was remote from the drying line Heretofore, it has been thought that it would be possible to apply the finish more uniformly if the tow were dry. This has involved the great expense of drying operations, and we have found that it is entirely possible to apply the finish extremely uniformly, using the wet, in-line process in accordance with this invention.

The process of this invention greatly shortens the processing time, makes it more economical, and produces a flock of excellent quality. However, the processing conditions as heretofore stated are quite critical and it is highly important to observe and to practice the processing steps referred to in the specification and specifically defined in the claims.

It will be apparent, however, that it is possible to utilize various chemical formulas for use in the scour solution, and for use in the finish solution, varying and depending in many cases upon the nature of the tow itself. Further, many other variations may be made without departing from the spirit and scope of this invention, including variations of the linear speed and tension of the tow as it passes through the process.

However, it is preferred to control the drying operation and th beating operation, to provide critically controlled moisture regain values both coming out of the dryer and coming out of the beater.

In connection with the product from the dryer, the following percentages of moisture regain are necessary:

| | % Regain | |
|---|---|---|
| | AC Flocking | DC Flocking |
| for rayon | 6 – 8% | 10 – 12% |
| for nylon | 2 – 2.4% | 3 – 5% |
| for polyester | 1 – 2% | 1 – 2% |
| for acrylic | 1 – 2% | 1 – 2% |

Further, it is of preferred importance to maintain the moisture regain percentage, with respect to beaten fibers collected in the cyclone 112 and delivered for screening, as follows:

| | % Regain | |
|---|---|---|
| | AC Flocking | DC Flocking |
| for rayon | 5 – 8 | 9 – 12 |
| for nylon | 1 – 2 | 2 – 5 |
| for polyester | ½ – 2 | ½ – 2 |
| for acrylic | ½ – 2 | ½ – 2 |

As stated, it is procedurally important to avoid allowing any air from the dryer to be conducted into the beater. It is hot and has considerable moisture in it. Accordingly, it is effective to isolate the product from the dryer, and to admit room air or the equivalent into the beater. In any event, it is important that the air entering the beater should have a temperature which is not greater than about 100° F.

As has been observed, it is important to heat set uncrimped tow, while straightened out and under tension, thus shrinking the fiber by heat, particularly in the case of polyester. Otherwise, after the polyester has been cut, it tends to shrink and curl, producing inferior grade flock. Further, with respect to acrylics, heat setting prevents curling and gives the acrylic fiber a straight characteristic. Similar comments apply with respect to rayon and nylon; it is highly preferably to remove the crimp while wet, using tension and hot water at the hot water rinse tank.

Of course, it will be appreciated that, within the limitations set forth above, many variations may be made in the apparatus and in the process which is selected for carrying out the invention. For example, the positions of certain processing stages may be changed with respect to each other suchthat the order of process steps is changed. As an example, the heater 21 may desirably be located just downstream of the squeeze rolls 30 when it is desired to squeeze out excess water prior to heat setting. Further, equivalent elements and process steps may be substituted for those specifically shown and described, apparatus components and process steps may in some cases be reversed, and certain features may be used independently of other features, all without departing from the spirit and scope of the invention as defined in the appended claims.

We claim:

1. In a continuous in-line method for making flock from a tow selected from the group consisting of rayon, nylon, polyester and acrylic which comprises a plurality of filaments and which contains a lubricant which is detrimental to said flock, the steps which comprises:

a. continuously feeding the tow and said lubricant as a running tow, b. continuously scouring said tow by contacting it with a liquid scouring agent for removal of said lubricant from said tow, c. continuously squeezing excess scouring liquid from said tow, d. continuously rinsing said tow with water, e. continuously applying a predetermined pressure to squeeze excess rinse water from said rinsed tow, f. continuously applying a liquid finish to said tow, g. continuously applying another predetermined pressure of from about 60 to 100 lbs./square inch to said tow to remove a portion of the applied finish, h. continuouslycutting the resulting tow into flock, i. continuously drying the resulting wet flock wherein the drying step is controlled to moisture regain values of:

| | % Regain | |
|---|---|---|
| | AC Flocking | DC Flocking |
| for rayon | 6 – 8 | 10 – 12 |
| for nylon | 2 – 2.4 | 3 – 5 |
| for polyester | 1 – 2 | 1 – 2 |
| for acrylic | 1 – 2 | 1 – 2 |

to produce a moist, hot air by-product, and wherein said by-product is continuously diverted from said flock, j. continuously beating the resultant dried flock with the admission of air, wherein the temperature of said admitted air is below about 100° F, and k. packaging the flock.

2. The method defined in claim 1, wherein said flockis precision cut in step (h).

3. The methoddefined in claim 1, wherein excessively long particles of the dried cut flock are screened and random cut and are mixed with the cut flock product.

4. The method defined in claim 1, wherein said flock is selected from the group consisting of rayon, nylon, polyester and acrylic and is beaten and collected and after collection has the following moisture regain values:

| | % Regain | |
|---|---|---|
| | AC Flocking | DC Flocking |
| for rayon | 5 – 8 | 9 – 12 |
| for nylon | 1 – 3 | 2 – 5 |
| for polyester | ½ – 2 | ½ – 2 |
| for acrylic | ½ – 2 | ½ – 2 |

5. The process defined in claim 1,wherein said tow is crimped, and further including the step of continuously decrimping said tow by tension in contact with a liquid.

6. The process defined in claim 1, wherein said tow is uncrimped, and further including the step of heat treating said uncrimped tow while running.

7. The process defined in claim 1, wherein said tow is dyed after said scouring step (b) and said squeezing step (c).

8. The process defined in claim 1, wherein said tow is bleached after said scouring step (b) and said squeezing step (c).

* * * * *